United States Patent [19]

Barret et al.

[11] Patent Number: 5,020,247

[45] Date of Patent: Jun. 4, 1991

[54] SLIDE FASTENER FOR SPORT SHOES, PARTICULARLY FOR CROSS-COUNTRY SKIING

[75] Inventors: Thierry Barret, Pringy; Pierre Rullier, Annecy, both of France

[73] Assignee: Salomon S.A., Annecy Cedex, France

[21] Appl. No.: 366,176

[22] Filed: Jun. 14, 1989

[30] Foreign Application Priority Data

Jun. 17, 1988 [FR] France ..... 88 08405

[51] Int. Cl.[5] ..... A43B 11/00; A43B 5/04

[52] U.S. Cl. ..... 36/50; 36/117; D2/276; D2/280

[58] Field of Search ..... 36/50, 117

[56] References Cited

U.S. PATENT DOCUMENTS

| | | | |
|---|---|---|---|
| 2,444,640 | 7/1948 | Epstein | 36/2.5 |
| 2,891,328 | 6/1959 | Volk | 36/50 |
| 2,970,390 | 2/1961 | Brough et al. | 36/7.3 |
| 4,392,311 | 7/1983 | Rudolf et al. | 36/50 |

FOREIGN PATENT DOCUMENTS

| | | | |
|---|---|---|---|
| 469626 | 7/1948 | Canada | 36/50 |
| 492066 | 7/1953 | Canada | 36/50 |
| 8203280 | 12/1982 | Fed. Rep. of Germany | 36/50 |
| 2549701 | 2/1985 | France | 36/50 |
| 193252 | 7/1986 | Italy | 36/50 |
| 380909 | 9/1932 | United Kingdom | 36/50 |
| 531776 | 1/1941 | United Kingdom | 36/50 |
| 2053657 | 2/1981 | United Kingdom | 36/50 |

OTHER PUBLICATIONS

Copy of French Search Report for French Application 88 08405.

"CS 420" Shown in Catalog TRAK 86–87 discloses a shoe having a hook and loop type fastener.

*Primary Examiner*—Paul T. Sewell
*Assistant Examiner*—M. D. Patterson
*Attorney, Agent, or Firm*—Sandler, Greenblum & Bernstein

[57] ABSTRACT

A slide fastener for a sport shoe in which the slide fastener is mounted on the upper anterior part of the upper of the shoe and extends in an inclined direction from the metatarso-phalangeal articulation area of the big toe towards the area of the opposite malleolus. In this way, deformations of the slide fastener caused by flexing of the shoe are eliminated. The slide fastener may also be reversely mounted to the interior of the upper to protect the slide fastener from snow, frost, and dirt. The shoe may be a cross-country skiing shoe.

7 Claims, 4 Drawing Sheets

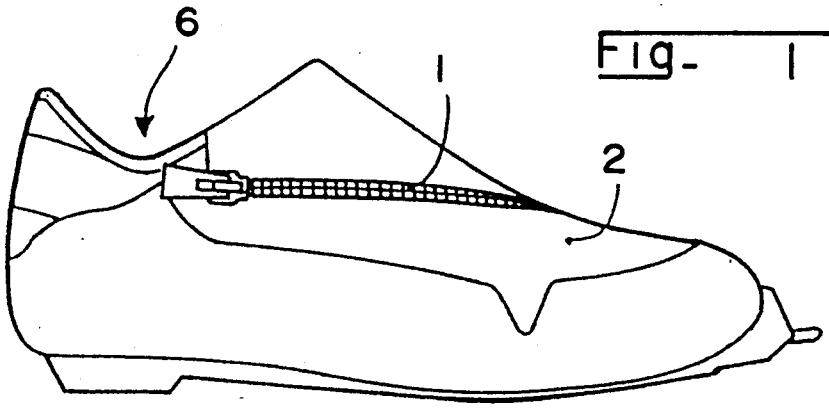
Fig- 1
Fig- 2
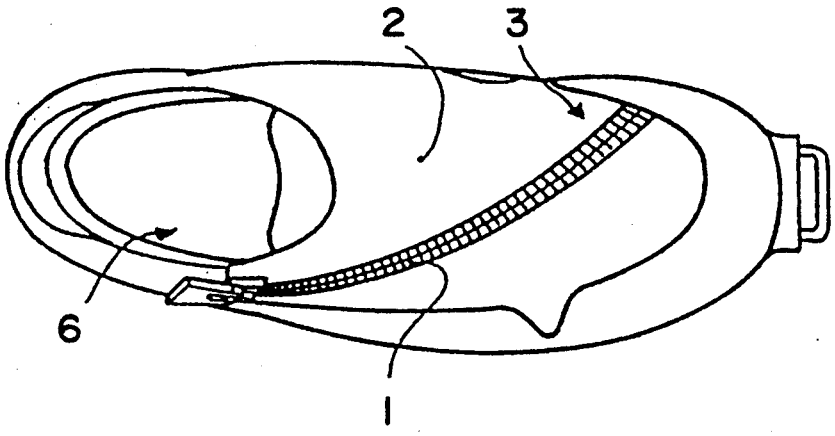

SLIDE FASTENER FOR SPORT SHOES, PARTICULARLY FOR CROSS-COUNTRY SKIING

BACKGROUND OF THE INVENTION

1. Field of the Invention

The present invention relates to slide fasteners, or zippers, for sport shoes, and particularly for cross-country skiing.

2. Description of Background and Relevant Information

The use of slide fasteners on shoes is common because of their practicality. Such fasteners have a general imperviousness to exterior influences because of the slider which extends continuously on the upper of the shoe. The slider is easy to maneuver for opening and closing, and the mounting of the slide fastener avoids the covering of areas of the shoe by two layers of material in areas of the shoe where the foot of the wearer bends, as is the case of fasteners of the "hook and loop" type or buttons. Examples are the shoe model "CS 420" shown in the catalogue "TRAK 86-87", as well as the shoe disclosed in the patent for Italian Industrial Design No. 193 252 wherein the fastener is of the "hook and loop" type. In these shoes, the area of the upper which closes the shoe on the foot covers the opposite area on which it is fastened over a wide area. In such constructions, not only does the necessity of covering the closure area lead to additional layers of material and thus a higher cost, but the covering of the closure area affects the flexibility of the upper because of the superposition of material which substantially doubles the thickness of the wall of the upper in the closure area.

For the above reasons, slide fasteners are often preferred over other types of fasteners. For example, the shoes described in the British patent documents Nos. 531,776 and 380,909, the French application for certificate of usage No. 2,549,701, and U.S. Pat. Nos. 2,444,640 and 2,970,390 use slide fasteners. The shoes illustrated in these documents have at least one slide fastener, arranged on the upper anterior part of the upper of the shoes. These slide fasteners are essentially oriented along the longitudinal axis of the shoe or parallel thereto. In the particular construction of U.S. Pat. No. 2,444,640, the fastener wraps around the upper anterior part of the upper and retains it on the lower part of the upper.

These shoes are relatively convenient to put on and to remove. However, they have significant disadvantages for use in a sport, particularly when the foot must bend in a repeated intensive fashion by flexing, such as is in cross-country skiing or running. In effect, the slide fasteners are relatively inflexible in the longitudinal direction of their mounting, and this mounting on the upper in the longitudinal direction appreciably hinders bending or flexing. The variation in curvature and the folding of the material of the upper causes significant variation of pressure, particularly on the anterior part of the foot between the top of the instep and the metatarso-phalangeal articulation area. This can cause discomfort and the advent of localized pain.

The present invention eliminates the disadvantages of shoe fasteners having a covering of the upper areas of the upper, and more particularly, the disadvantages relating to slide fasteners by eliminating the large deformations of the slide fastener when flexing the upper during bending of the foot.

SUMMARY OF THE INVENTION

According to the invention, a sport shoe having a mean longitudinal axis includes a slide fastener mounted on the upper anterior part of an upper of the shoe, wherein the the fastener extends on the upper in a direction inclined with respect to the mean longitudinal axis of the shoe. The slide fastener extends from the front of the foot of the wearer, beginning at the metatarso-phalangeal articulation area and runs over the instep towards the rear and the area of the opposite malleolus. More particularly, the slide fastener extends from the articulation area of the first metatarsus and the first phalange of the big toe to the area substantially vertically above the cuboid bone. According to another aspect of the invention, the slide fastener is reversely mounted on the upper of the shoe, so that teeth of the teeth chains of the slide fastener are located on the internal side of the upper. The teeth chains are affixed to a single side of a corresponding support tape. A slider is mounted on the slide fastener so that a pull on the slider projects towards the exterior of the upper and opposite to the teeth chains.

According to another aspect of the invention, at least part of the upper is made of a stretchable material and, preferably, the stretchable material is impervious. The the sport shoe may be a cross-country skiing shoe.

BRIEF DESCRIPTION OF THE DRAWINGS

The invention is further explained in the description which follows with reference to the drawing illustrating, by way of non-limiting example, an embodiment of the invention, wherein:

FIG. 1 shows a side view of the exterior side of a right cross-country ski shoe fitted with a slide fastener according to the invention;

FIG. 2 is a top view of the shoe of FIG. 1;

DETAILED DESCRIPTION OF THE PREFERRED EMBODIMENTS

Figure 3:
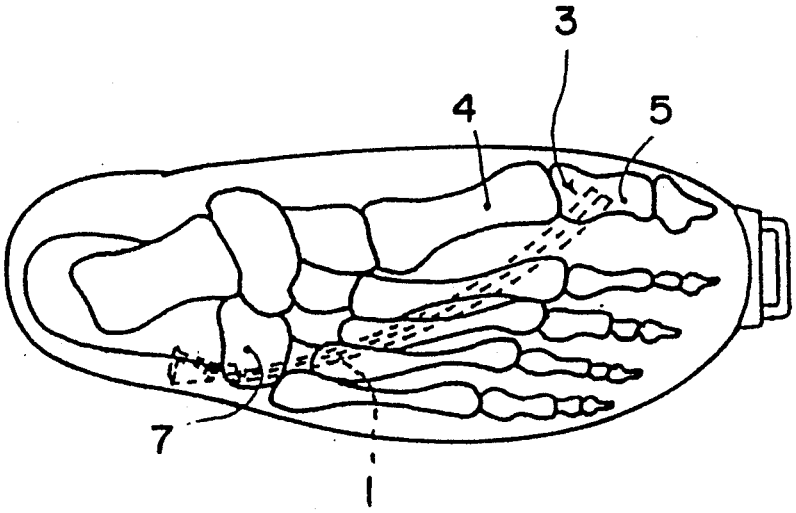
FIG. 3, is a top view corresponding to FIG. 2, showing the relative position of the skeleton of the wearer's foot with respect to the slide of FIGS. 1 and 2.
Figure 4:
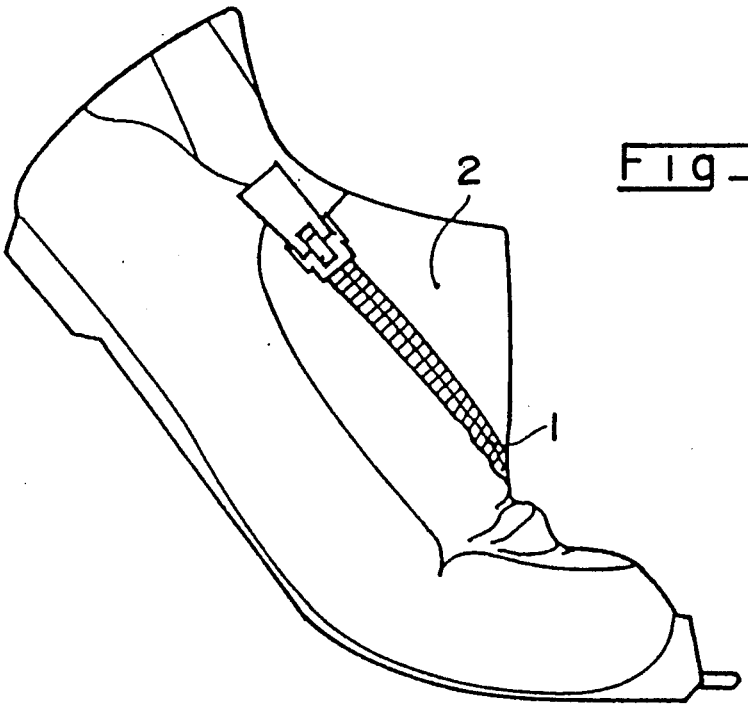
FIG. 4 shows a side view of the shoe during flexing of the upper during the bending of the wearer's foot.
Figure 5:
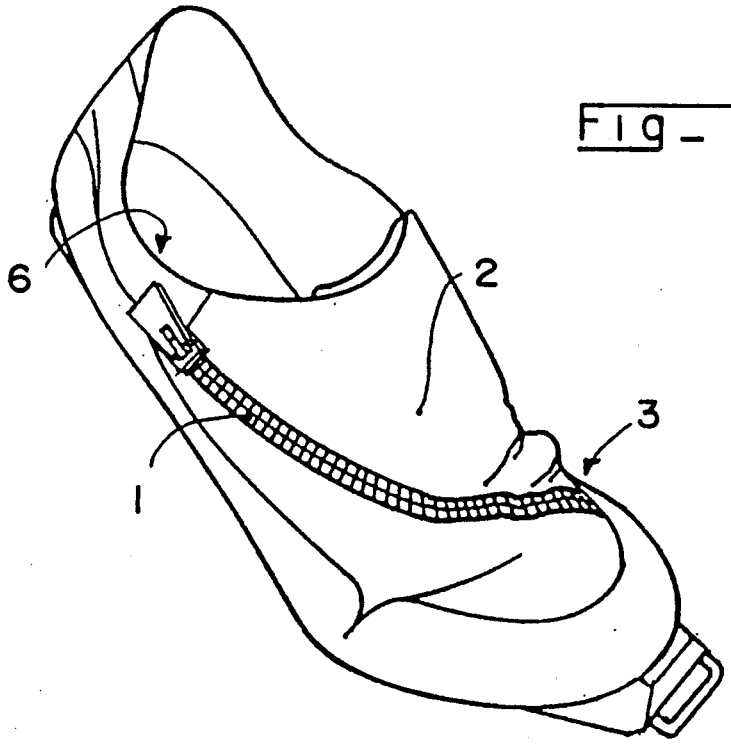
FIG. 5 is a perspective view of the shoe during the same phase of flexion as shown in FIG. 4.

As seen in the figures which illustrate the example of a slide fastener of the invention on a cross-country ski shoe, slide fastener 1 is positioned on an upper 2 and extends along a direction inclined with respect to the mean longitudinal axis of the shoe. Thus, most problems connected to the disadvantages of longitudinal deformability of the slide fastener 1 are eliminated since the bending of the foot occurs generally around instantaneous axes of rotation substantially perpendicular to the longitudinal axis of the shoe.

The metatarso-phalangeal articulation area 3 of the foot is the most flexed during bending of the foot. This occurs most particularly at the internal side, i.e., between the first metatarsus 4 and the first phalange 5 of the big toe. The upper 2 sustains the maximum deformation during flexion in this area and it is advantageous for the slide 1 to be removed from this area 3.

The slide fastener 1 runs from area 3 on the upper 2 towards the rear and the external side of the instep in the direction of the zone 6 of the external malleolus of the foot (the rounded lateral projection of the bone of the leg at the ankle) and stops approximately vertically above the cuboid bone 7.

In this embodiment of the slide fastener 1, the flexion areas are located only in the metatarso-phalangeal area 3. The flexing of the slide fastener is reduced, since it is located away from the flexion axis, which is approximately transverse to the shoe. This approximates a flexion situation in which the upper does not have a slide fastener.

The part of slide fastener 1 which runs on the side of the instep is not subjected to flexion and thus to deformation in this area of the foot. Therefore, the slide fastener more efficiently ensures a good hold of the foot in the shoe without causing discomfort.

Figure 6:
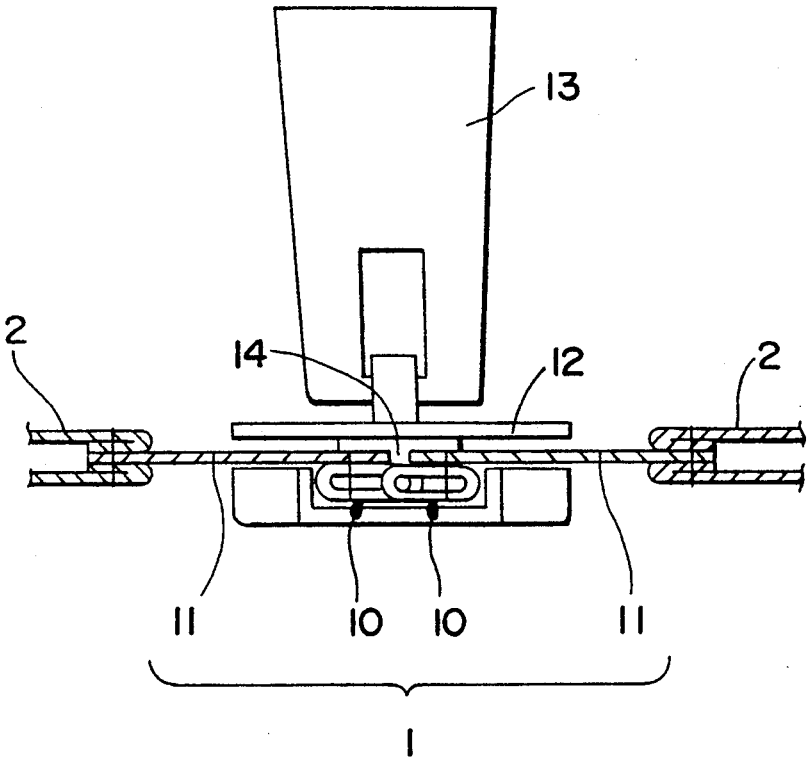
FIG. 6 is a sectional view of the slide fastener of this invention reversely mounted on the upper of a shoe.

Additional arrangements can also be provided to protect the slide fastener from snow, frost and miscellaneous sources of dirt. As illustrated in FIG. 6, a mounting of the slide fastener 1 is of the reverse type, i.e., in which the teeth of the teeth chains 10 are located on the internal side of the upper 2. To this end, preferably a slide fastener 1 in which the teeth chains 10 or spirals are fixed and applied on a single side of the support tape 11 is used. This side of the tape is then mounted on the internal side of upper 2.

In such an arrangement, the slider 12 is mounted on the slide fastener 1 such that its pull 13 is on the outside of upper 2 of the shoe and opposite the teeth of the teeth chains.

Furthermore, to perfect the protection of the teeth chains of such a slide fastener the teeth chains are preferably fixed at the edge of the border of their respective support tape or even substantially set back therefrom. Thus, during the closure of the slide fastener 1 by means of the slider, the borders of the two support tapes come together and there is no more than a narrow slit 14 in the location of slide fastener which presents itself towards the exterior of upper 2.

Without going beyond the scope of the invention, the upper 2 of a shoe can, at least in the upper covering zone of the foot, be provided with a stretchable and/or elastic material. The material could also be impervious. In this way the upper 2 tightly covers a foot of varying sizes. Alternatively, only one or the two parts of upper 2 adjacent to the slide fastener 1 can be made of such a material.

Although the invention has been described with reference to particular means, materials and embodiments, it is to be understood that the invention is not limited to the particulars disclosed and extends to all equivalents within the scope of the claims.

We claim:

1. A shoe having a longitudinal axis, comprising a slide fastener mounted on the upper anterior part of an upper of the shoe, wherein the side fastener extends on the upper in a direction inclined with respect to the longitudinal axis of the shoe, and extends from the front of the foot of the wearer, beginning in the area of the first metatarso-phalangeal articulation area and running over the instep towards the rear and the area of the opposite malleolus.

2. The shoe according to claim 1, wherein the slide fastener extends from the articulation area of the first metatarsus and the first phalange of the big toe to the area substantially vertically above the cuboid bone.

3. The shoe according to claim 1, wherein the slide fastener is reversely mounted on the upper of the shoe, so that teeth of teeth chains of said slide fastener are located on the internal side of the upper.

4. The shoe according to claim 3, wherein the teeth chains are affixed to a single side of a corresponding support tape.

5. The shoe according to claim 4, wherein a slider is mounted on the slide fastener so that a pull on said slider projects towards the exterior of the upper and opposite to the teeth chains.

6. The shoe according to claim 1, wherein at least part of said upper is made of a stretchable material.

7. The shoe according to claim 1, wherein said shoe is a cross-country skiing shoe.

* * * * *